United States Patent [19]

Sutter

[11] Patent Number: 5,054,782

[45] Date of Patent: Oct. 8, 1991

[54] TOY GAMING DEVICE

[75] Inventor: James J. Sutter, New Territories, Hong Kong

[73] Assignee: Kulay Manufacturing Limited, Hong Kong, Hong Kong

[21] Appl. No.: 464,833

[22] Filed: Jan. 16, 1990

[51] Int. Cl.[5] ..... A63F 5/04

[52] U.S. Cl. ..... 273/143 R; 446/9

[58] Field of Search ..... 273/142 Y C, 142 J D, 273/143

[56] References Cited

U.S. PATENT DOCUMENTS

| | | | |
|---|---|---|---|
| 3,406,976 | 10/1968 | Van Woert, Jr. | 273/143 R |
| 3,565,441 | 7/1971 | Matsumoto | 273/143 R |
| 3,747,936 | 7/1973 | Ohki | 273/143 R |
| 4,504,058 | 3/1985 | Itoh | 273/143 R |
| 4,666,159 | 5/1987 | Sutter | 273/143 R |
| 4,838,554 | 6/1989 | Sutter et al. | 273/143 R |

FOREIGN PATENT DOCUMENTS

| | | | |
|---|---|---|---|
| 0259125 | 3/1988 | European Pat. Off. | 273/143 R |
| 2060874 | 6/1971 | Fed. Rep. of Germany | 273/143 R |

*Primary Examiner*—Edward M. Coven
*Assistant Examiner*—Raleigh W. Chiu
*Attorney, Agent, or Firm*—Townsend and Townsend

[57] ABSTRACT

A toy money box in the form of a slot machine which has a coin store for a jackpot prize. That store has a hinged base which is normally held shut by engagement with a cam, displacement of the cam upon sensing of a winning combination for the chance wheels releasing the hinged base to release prize money. Additionally a clutch mechanism is provided between the operating handle and the operating mechanism. This reduces the chance of damage to the operating mechanism should the handle be operated when the mechanism is jammed. The wheels are set in rotation by spring loaded fingers which drive said wheels, said fingers being moved to their loaded position by said clutch and engaging a stop to causing said clutch to release the fingers which spring back and spin the chance wheels. The wheels are stopped at random orientations by the engagement of the ends of arms formed as part of a single integrally moulded member, the arms being resiliently biased away from the wheels by cam means which release the arms after the wheels have been set in rotation.

14 Claims, 9 Drawing Sheets

TOY GAMING DEVICE

This invention relates to toy gaming devices and in particular a toy which resembles a slot machine or one-armed bandit as they are sometimes called and which can additionally act as a toy money box if desired.

BACKGROUND TO THE INVENTION

Toy money boxes come in various forms from the simplest piggy bank which is a housing in some pleasing shape with a slot at the top in which to insert coins and a temporary opening closed by a cap or the like at the bottom or the back through which the money saved can be recovered when required.

An object of the present invention is to provide a toy money box which resembles a slot machine and so provides an added degree of interest.

The full size slot machines are highly complex pieces of machinery and so the toy according to the invention needs to be relatively simple in its construction and operation.

There have been a number of proposals in the past to make toy money boxes in the form of slot machines and examples are U.S. Pat. Nos. 4261571 and 4504058. Both of these patents, however, show mechanisms which are complex, are difficult to assemble and therefore overall are expensive.

My U.S. Pat. No. 4646159 discloses a design which is simpler and cheaper in its construction. The present invention aims to provide additional amplification of the construction of such a product.

According to the invention in one aspect there is provided a toy money box comprising:

an outer casing, coin inlet formed in said casing, a money store within said casing into which coins pass when inserted through said coin inlet, a number of rotatable chance wheels mounted in said casing and arranged to be spun and stopped at random orientations, indicia carried by said wheels, only certain of said indicia being winning indicia when a respective wheel stops with one of said certain indicia in a winning orientation, whereby when said wheels stop in a winning orientation the resulting array of indicia corresponds to a jackpot position, means within said casing for determining a jackpot position and releasing stored coins from said money store upon determination of a jackpot position, a handle pivotally mounted to said casing at an outer surface thereof about an axis of pivoting for setting said wheels spinning, spring loaded fingers mounted in said casing for engaging respective wheels, said fingers being movable to a loaded position in contact with said wheels whereby their release spins a respective wheel as said finger moves to a retracted rest position, a clutch mechanism driven by said handle, said clutch mechanism moving said fingers towards said loaded position as said handle is pivoted, continued pivoting of said handle releasing said clutch and said fingers whereby said fingers can then move to said retracted rest position, and said clutch mechanism including a crank pivotally mounted to said casing about said axis of pivoting and including a first arm having an outer end spaced from said axis, a finger integrally formed with said first arm and projecting from said outer end alongside said arm, recess means defined between said finger and said first arm, engagement means projecting from said spring loaded fingers and normally engaged in said recess means, so that pivoting movement of said handle and crank will produce a corresponding pivotal movement of said spring loaded fingers to said loaded position, a stationary abutment on said casing, a forward end of said finger engaging said abutment as said fingers approach said loaded positions, continued pivoting of said handle and said crank causing said abutment to displace said resilient finger to release said engagement means from said recess means.

With such a money box the coins are held in the money store until a winning jackpot is shown when they are automatically released. Preferably there is an additional coin inlet leading to a money storage compartment say in the base of the toy so that some money can be placed in the money store for release as a jackpot and some placed in the money storage compartment for saving.

The provision of the clutch mechanism also has a safety aspect since it ensures that if the toy's operating mechanism becomes jammed, operation of the handle will not damage the mechanism since instead the clutch will release. Thus, the finger will have some inherent flexibility and this finger can be designed to bend and release the clutch before any other part of the mechanism breaks.

In a preferred embodiment, the resilient finger of the toy money box further comprises a cam surface between said finger and said first arm and leading to said recess means, whereby said handle and crank are returned to their initial position after releases of said engagement means from said recess means, said engagement means engage said cam surface and resiliently displace said resilient finger to allow said engagement means to re-enter said recess means.

In another preferred embodiment, said first arm has a first contact surface at its outer end and said casing has contact means contacted by said first contact surface when the handle is in its non-operative position, and said crank further comprising a second arm projecting away from said first arm and having an outer end provided with a second contact surface, said second contact surface being contacted by said contact means on said casing once said handle has been pivoted to a position when said engagement means have released from said recess means, to thereby limit further pivoting movement of said handle.

Also an advantage of the invention is that the clutch mechanism can be made from a one-piece moulded crank which simplifies assembly.

Preferably the base to the money store is hingedly mounted and can hinge downwardly under its own weight when a jackpot prize is given, the base being normally held shut by an arrangement comprising:

an arm integrally formed with said base to said money store, said arm projecting away from said axis of pivoting of base, a crank pivotally mounted to said casing and resiliently urged about its axis of pivoting in a first direction, an arcuate cam surface on said crank engaging said arm and locking said arm and base in said normally closed position, and sensing means pivotally mounted in said casing for engaging said wheels to detect winning orientations of winning indicia, said sensor means being resiliently urged to a second position but stopped at a first position when said wheels are not all stopped in a winning orientation, said sensor means being movable to said second position when a jackpot position is detected, said sensor means engaging said crank when they move to said, second position to displace said crank in a direction opposite to said first direction, to release said arm from said arcuate cam surface to allow said base to hinge open.

According to another aspect of the invention there is provided a toy money box comprising:

an outer casing, a coin inlet formed in said casing a money store within said casing into which coins pass when inserted into said coin inlet, a base to said money store hingedly mounted to said casing at the outer surface thereof so as to be movable by hinging downwardly under its own weight between a normally closed position to retain coins in said store and an open jackpot position to release coins from said store, a number of rotatable chance wheels mounted in said casing and arranged to be spun and stopped at random orientations, indicia carried by said wheels, only certain of said indicia being winning indicia when a respective wheel stops with one of said certain indicia in a winning orientation, whereby when said wheels stop in a winning orientation the resulting array of indicia corresponds to movement of said base to said jackpot position, an arm integrally formed with said base to said money store, said arm projecting away from said axis of pivoting of base, a crank pivotally mounted to said casing and resiliently urged about its axis of pivoting in a first direction, an arcuate cam surface on said crank engaging said ar and locking said arm and base in said normally closed position, and sensing means pivotally mounted in said casing for engaging said wheels to detect winning orientations of winning indicia, said sensor means being resiliently urged to a second position but stopped at a first position when said wheels are not all stopped in a winning orientation, said sensor means being movable to said second position when a jackpot position is detected, said sensor means engaging said crank when they move to said, second position to displace said crank in a direction opposite to said first direction, to release said arm from said arcuate cam surface to allow said base to hinge open.

Such an arrangement has advantages of simplicity of construction and assembly.

BRIEF DESCRIPTION OF THE DRAWINGS

An example of a toy slot machine and money bank according to the invention will now be described with reference to the accompanying drawings, in which.

DESCRIPTION OF THE PREFERRED EMBODIMENT

Figure 1:
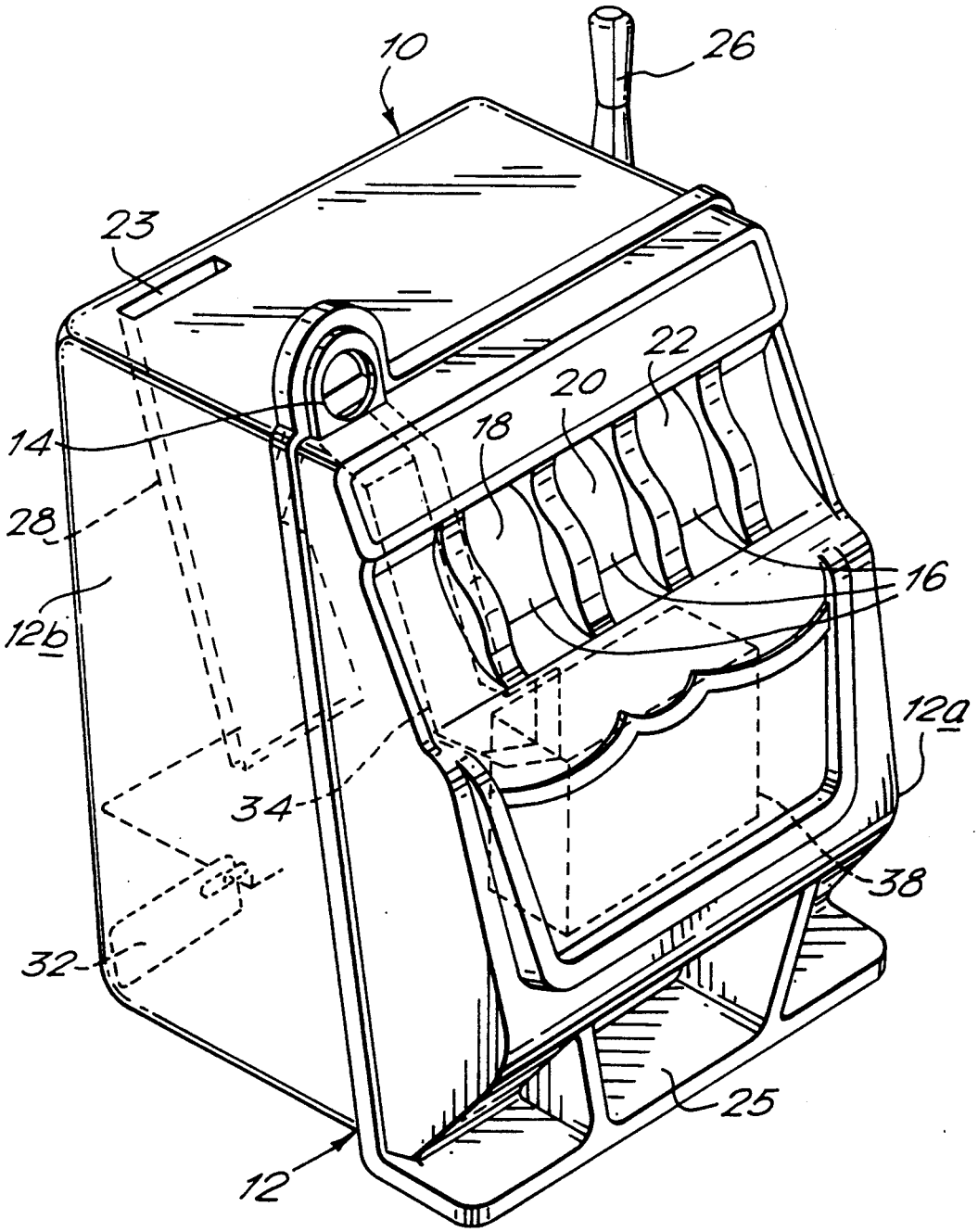
FIG. 1 is a perspective view with parts broken away.

The toy slot machine bank 10 shown in FIG. 1 includes an outer casing 12 in the shape of a conventional slot machine. The casing includes a front section 12*a* and a rear rectangular housing section 12*b*. At the top is a first coin input 14. In the front section are three openings 16 through which the peripheries of three chance wheels 18, 20 and 22 are visible. Also in the top is a second coin input 23.

Figure 2:
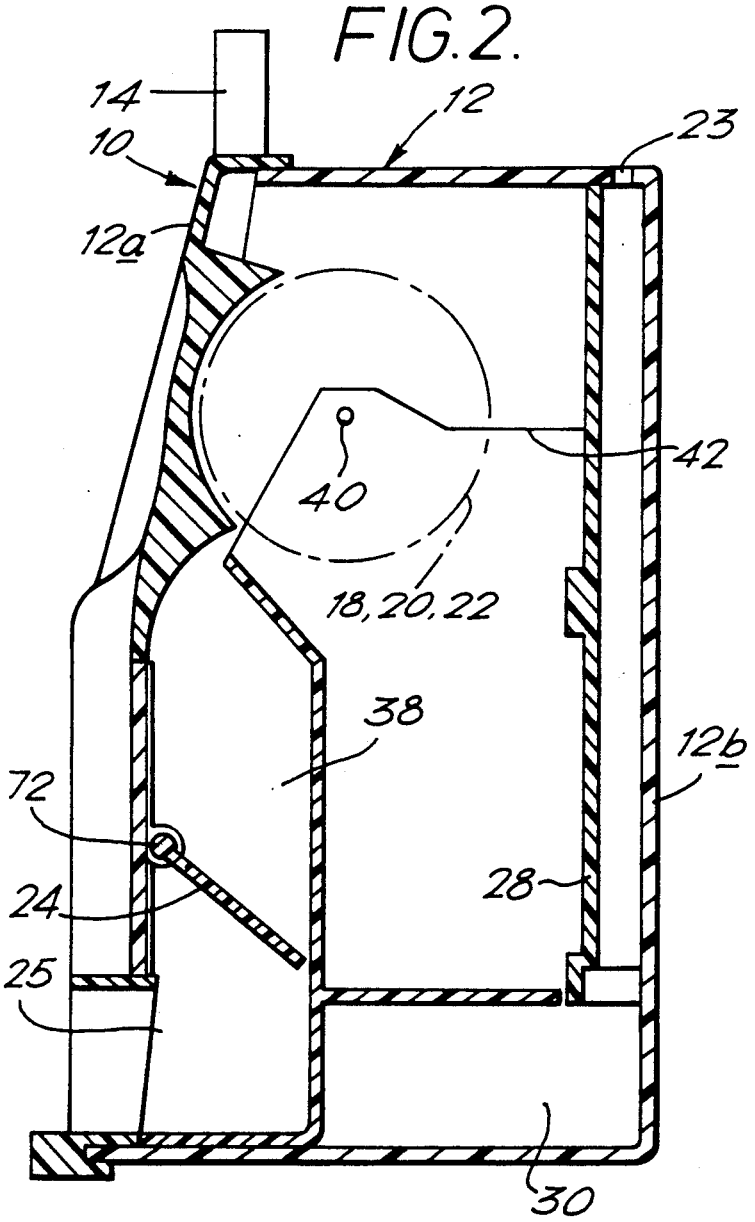
FIG. 2 is an upright cross section through the machine but omitting details of the operating mechanism.

The wheels 18, 20 and 22 carry markings around their peripheries including winning marks such as "BAR" and "7" and when all three wheels stop in a position say with a combination of three "BAR" and/or "7" marks all aligned, then that is associated with a jackpot prize. A door or base 24 (FIG. 2) will then open to release stored coins through an outlet 25 in the front section 12*a* of the casing 12. The bank also has a hinged lever or handle 26 which is used to operate the wheels 18, 20 and 22. The operation of the bank 10 to actuate the wheels is, however, independent of the deposit of a coin.

A coin inserted in the slot 23 will pass down a chute 28 to a money storage compartment 30 in the case. Such a coin is saved as in any "piggy bank" and when collected coins are needed, they can be removed by opening a door 32 at the base of the rear housing 12*a* of the casing 12.

A coin inserted in the input 14 enters a slot 34 and passes to a coin collecting box 38. The latter acts as a jackpot prize store so that coins entered through input 14 are temporarily stored until released through the door 24 which forms the bottom of the box 38.

The owner of the bank 10 can therefore enter some coins through the slot 23 to store them as in any piggy bank whilst others can be entered through the input 14 and they will be kept as a prize to be released when a prize is awarded. Unlike a conventional slot machine there is no question of a proportion of the money entered being retained by the machine; the bank 10 is a toy and the user has the choice of placing coins either in the compartment 30 for long term storage or in the box 38 for release as a prize from time to time.

Referring now more particularly to FIGS. 3 to 7, the chance wheels 18, 20 and 22 are rotatably mounted on an axle 40 carried by a frame 42 supporting the operating mechanism. As noted above and is best shown in FIG. 5, around the periphery of each wheel are a series of markings, some forming parts of arrays constituting winning scores such as "BAR" or "7" and others such as an orange, lemon or cherries forming parts of arrays constituting a losing score. Integrally projecting from the side face of each wheel are a circular set of teeth 44 analogous to the teeth of a gear wheel. The teeth have crests 44*a* and troughs 44*b*. It will be seen best from FIG. 5 that certain troughs are missing. Those missing correspond to, but are not necessarily angularly aligned with markings which forms part of a winning array. For example the missing trough indicated by the reference 44*c* corresponds with the winning marking "7" marked with the reference 46.

On the one hand the teeth 44 on each wheel 18, 20 or 22 are engaged by respective stop levers 48 and on the other hand they are engaged by sensing levers 50. The heads of the levers 48 have a triangular shaped cut-out 49 and the crest 44*a* of any tooth 44 will engage in that cut-out 49, irrespective of whether the corresponding trough 44*b* between any pair of crests 44*a* is missing.

The wheels 18, 20 and 22 are set in rotation as will be described and the levers 48 and 59 will also have been pivoted clear of the teeth 44 as will be described. Then the levers 48 are one by one released and bend inwardly as a result of their inherent resilience into engagement with a random tooth 44 to stop rotation of the appropriate wheel and temporarily to lock the wheel in that random position.

The levers 48 are integrally formed as parts of a member 52 moulded in one piece from synthetic plastics material, the levers 48 being joined at their lower ends by a strip 54. The strip 54 is joined as a snap-fit over small lugs 55 which are formed as bent-up portions from the material of the frame 42, the strip having integral downwardly extending lugs 54*a* which are a snap-fit under the frame 42. Such an arrangement enables quick and easy assembly. As an alternative, however, the levers 48 could be moulded as an integral part of the frame 42.

Each lever 48 also has a cam face 48*b* intermediate its ends. These cam faces are engaged by a member 56, pivotally mounted about an axle 57. As best seen in FIG. 7, these cam faces are at different levels for each lever. Thus when the member 56 is pivoted up to the position shown in broken lines in FIG. 6, the free ends of the levers 48 are moved away from engagement with the teeth 44 to the position shown in broken lines in FIG. 6. The wheels 18, 20 and 22 are then free to rotate. However, as the member 56 pivots down to the full line position shown in FIG. 6, the inherent resiliency of the levers 48, brings the cut-outs 49 into engagement with the teeth 44 and so stops the wheels 18, 20 and 22.

Figure 3:
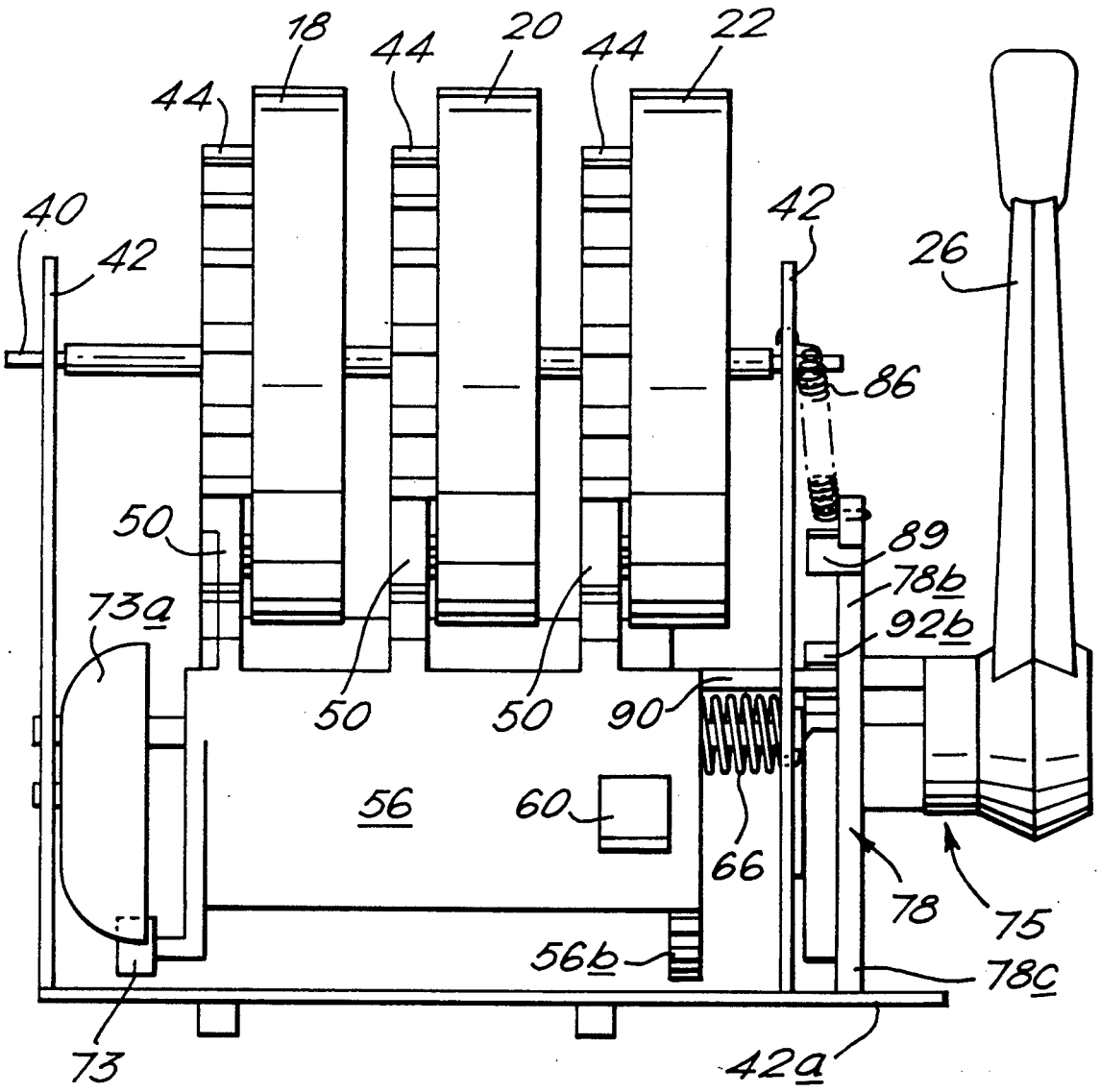
FIG. 3 is a front elevational detail of the mechanism for rotating and stopping the chance wheels.
Figure 6:
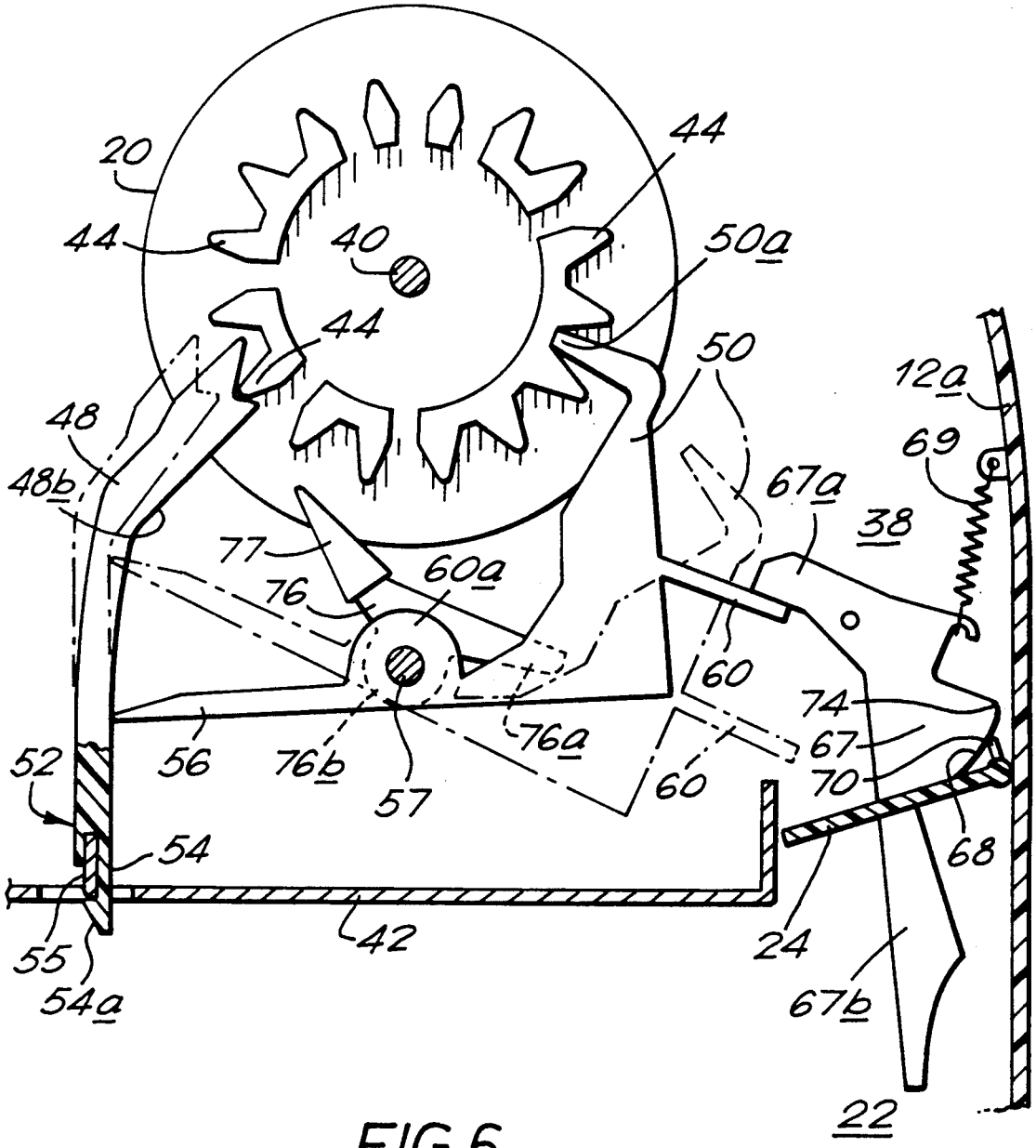
FIG. 6 is a sectional detail showing the parts controlling the release of the money door and spinning and stopping of the wheels.
Figure 7:
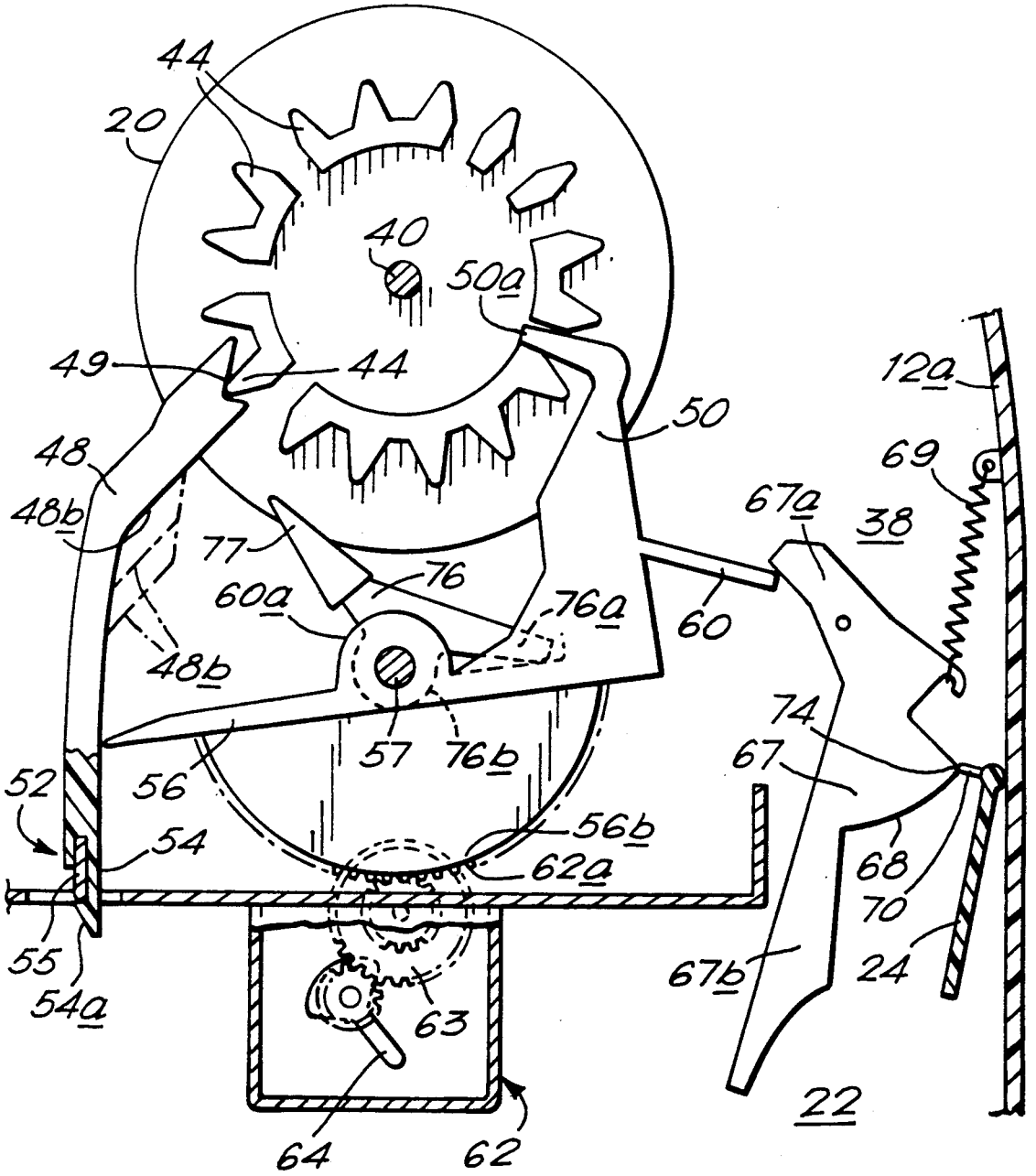
FIG. 7 is a detail similar to FIG. 6 with the money door in the open position.

It will be noted from FIG. 7 that the cam faces 48*b* of the three levers 48 vary such that as the member 56 progressively moves to its full line position in FIG. 6, first of all the right-hand lever 48 as viewed in FIG. 3, then the middle and finally the left hand lever 48, are released to allow their respective cut-out 49 to engage a respective tooth 44 on the wheels 18, 20 and 22 and so stop the respective wheel. In this way the wheels are stopped in turn, one by one.

Figure 4:
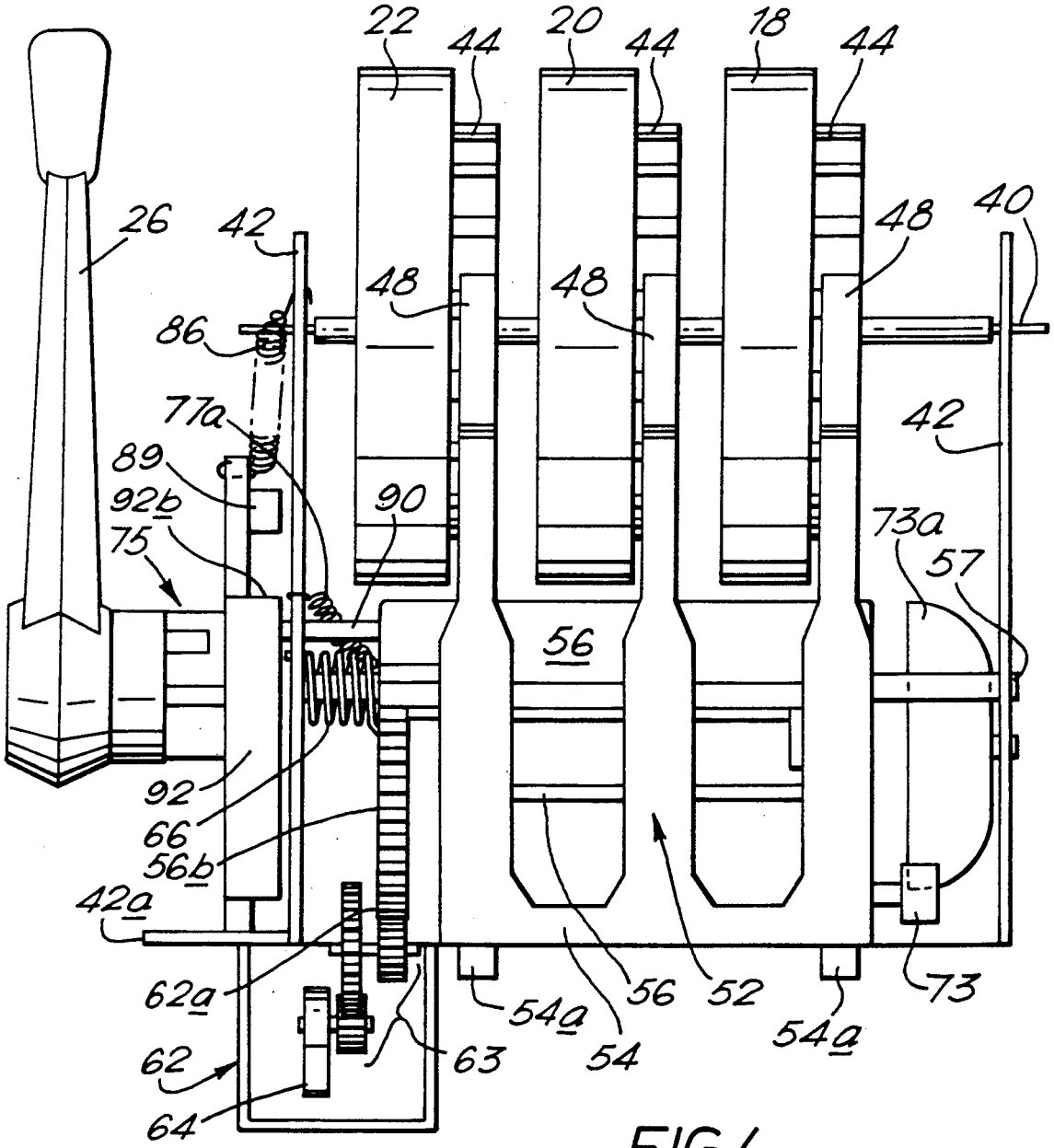
FIG. 4 is a rear elevational detail of the mechanism shown in FIG. 2.
Figure 5:
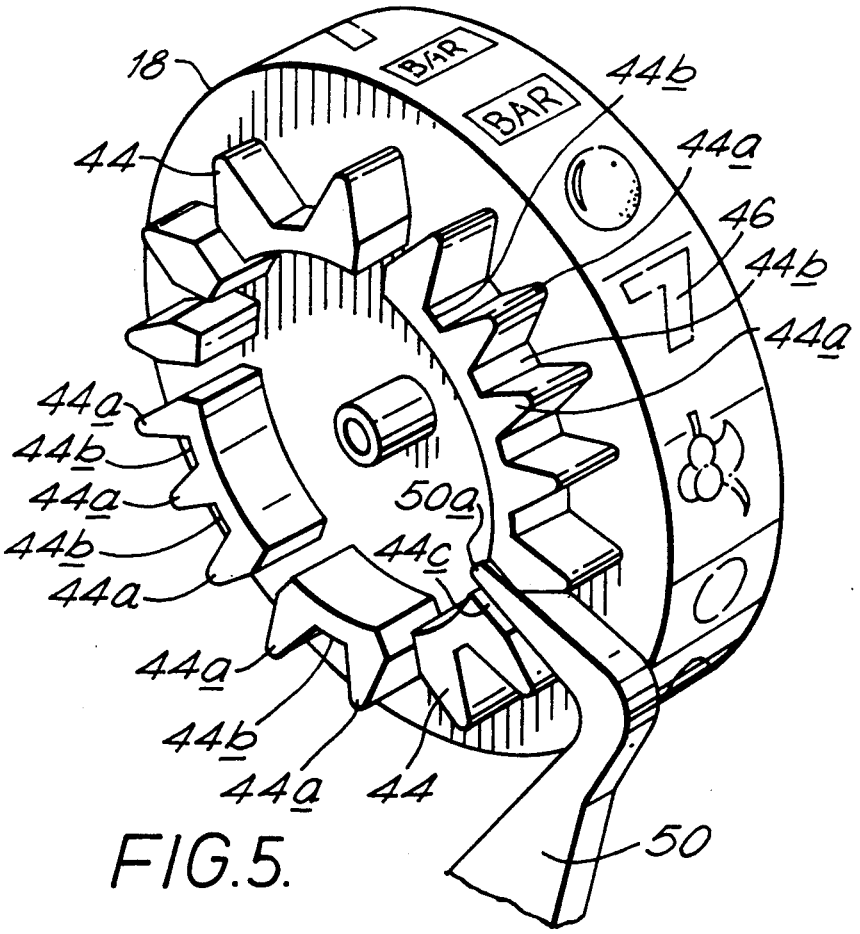
FIG. 5 is a perspective detail of one of the chance wheels.

In order to space out the stopping of the wheels 18, 20 and 22 in this way and allow the wheels to rotate several times even before the first wheel is stopped, an air damper arrangement 62 is provided. This is best shown in FIGS. 4 and 7 and include a sector shaped gear 56*b* integrally formed with the member 56. This gear has teeth 62*a* which engage with the input gear of a step up gear train 63. The output from that gear train 63 drives a rotatable eccentric air vane 64. This air damper arrangement 62 provides the necessary resistance to prevent quick pivoting movement of the member 56, the latter being urged from its rest position as shown in full lines in FIG. 6 by a spring 66 mounted about the axle 56 and acting between the member 56 and the frame 42. As the member 56 is pivoted to its position shown in broken lines in FIG. 6, the spring 66 is tensional and it urges the member 56 back to the full line position shown in FIG. 6 against the slowing effect of the air damper arrangement 62.

The three sensing levers 50 are integrally formed a fingers upstanding from the member 56. That member is pivotally mounted to the frame 42 about the axle 57 by means of a pair of integral lugs 60*a*. Since the three levers 50 are joined and so can only move together, the three respective noses 50*a* at the ends of the levers 50 can only enter a missing trough 44*b* when all three happen to be aligned with missing troughs. In other words the member 56 and the associated levers 50 can only move from the full line position shown in FIG. 6 to the position shown in FIG. 7 when a winning combination of markings is shown by the chance wheels 18, 20 and 22. Additionally the damper arrangement 62 ensures that the three respective noses 50*a* will only reach the region of the teeth 44 after the three wheels 18, 20 and 22 have been first of all stopped in turn by the levers 48 and in that connection it will be noted that the cam faces 48*b* are shaped so that levers 48 engage the teeth 44 on all three wheels long before the levers 50 engage the teeth of all three wheels.

Integrally formed with the member 56 and extending forwardly into the coin collecting box 38 is a lug 60. This lug 60 contacts a pivotally mounted crank 67 having arms 67*a* and 67*b*. The arm 67*b* has a cam surface 68. Bearing against the latter surface is an arm 70 formed integrally with the hinged door 24 at the lower end of the coin box 38. The crank 67 is urged by a spring 69 engaging a stop 67*c* on the arm 67*b* in an anti-clockwise direction as viewed in FIG. 6.

The door 24 is pivotally mounted about pivot pins 72 and when unsupported will hang down as shown in FIG. 7. The engagement of the arm 70 with the cam surface 68, however, holds the door 24 supported in the position shown in FIGS. 6 and 8. Thus the weight of any coins in the coin box will be carried by the crank 67 and the door will remain closed and the spring 69 will urge the crank 67 into a position such that it holds the door closed. However, once the crank 67 is pivoted to the position shown in FIG. 7, against the effect of the spring 69 by the raising of the lug 60, this releases the arm 70 and the door 20 will hinge downwardly under its own weight to release any coins in the box 38.

In that connection the lug 60 will only pivot the arm 67*a* when a winning score exists. Thus, normally the lug 60 cannot move beyond the full line position shown in FIG. 6 where the nose 50*a* of at least one of the arms 50 engages a crest 44*b*. However, when all three wheels are in a winning array, all of the noses 50*a* can penetrate in beyond the teeth as is shown in FIG. 7. Then the member 56 can pivot in an anti-clockwise sense and so the lug 60 engages under the arm 67*a* and pivots the crank 67 to release the door 24 as has been described. In addition the member 56 carries a metal washer 73 which then contacts a small bell 73*a* to make a winning sound as the door 24 is released.

When the lug 60 is moved back to retract the noses 50*a* from the missing troughs 44*b* and the chance wheels 18, 20 and 22 are to be operated again, the crank 67 is released and it is pivoted by the spring 69 back to the position shown in FIG. 6. Initially the end 74 of the cam surface 68 engages the arm 70 and causes the door 24 to pivot up to its closed position and thereafter the circular cam surface 68 locks against the arm 70 and holds the door 24 in the closed position.

It will also be noted that the lower end of the arm 67*b* of the crank 67 extends down into the outlet 22, and if desired a child can depress it to release the door 24. This saves possible damage to the door 24 and arm 70 if a child tries to force the door 24 open.

As noted above the toy 10 has a hinged handle 26 for operating the chance wheels 18, 20 and 22. The handle is attached to a clutch 75 rotatably carried by the axle 57. In turn the clutch 75 is connected to drive a member 76 also pivotally mounted about the axle 57 by means of a pair of lugs 76*b*. It has a front contact surface 76*a* which bears against the member 56 and has three integrally formed operating fingers 77, one mounted in alignment with the teeth 44 of a respective wheel 18, 20 or 22.

Figure 8:
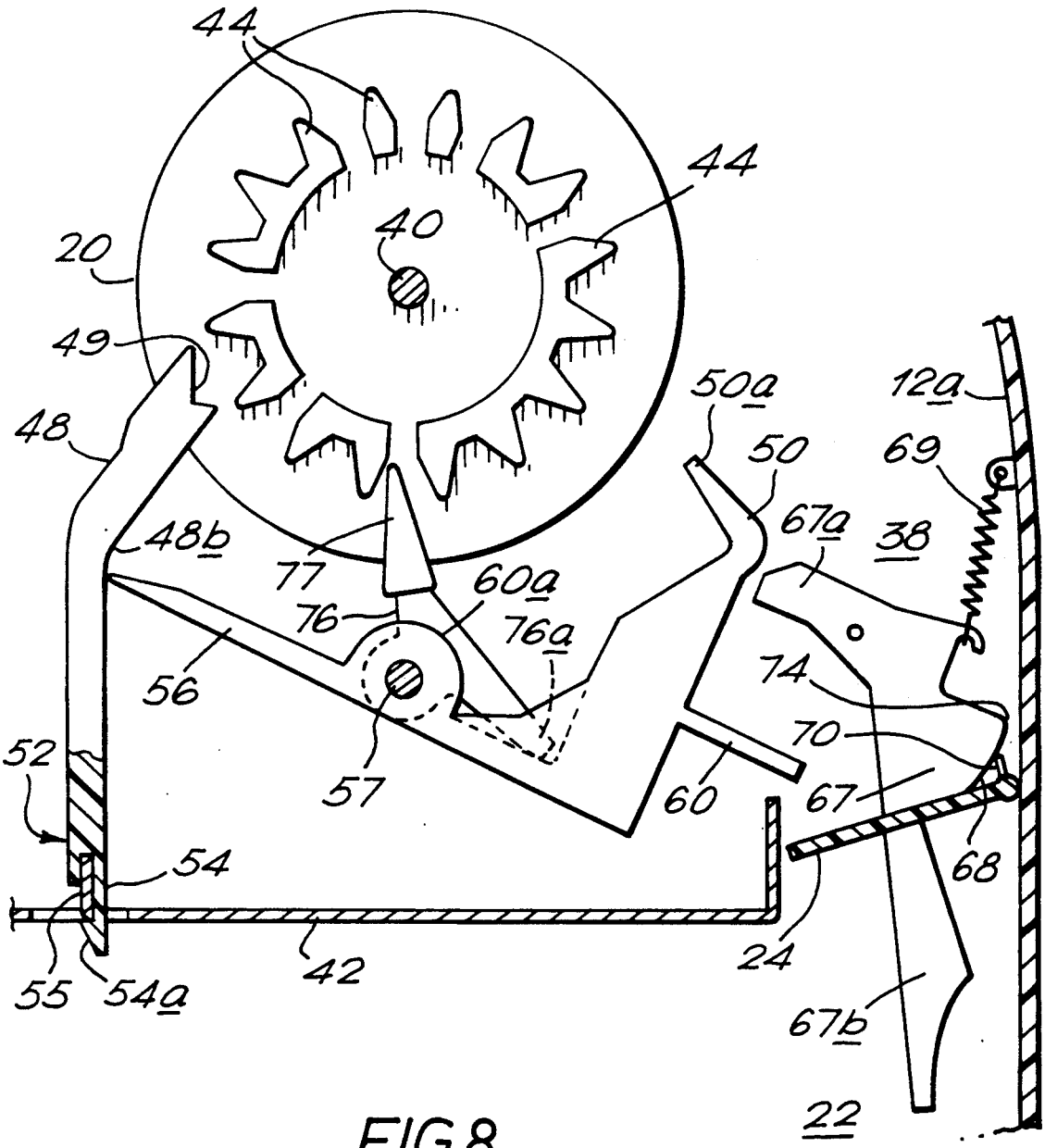
FIG. 8 is a detail similar to FIG. 6 showing the wheels about to be spun.
Figures 9, 10:
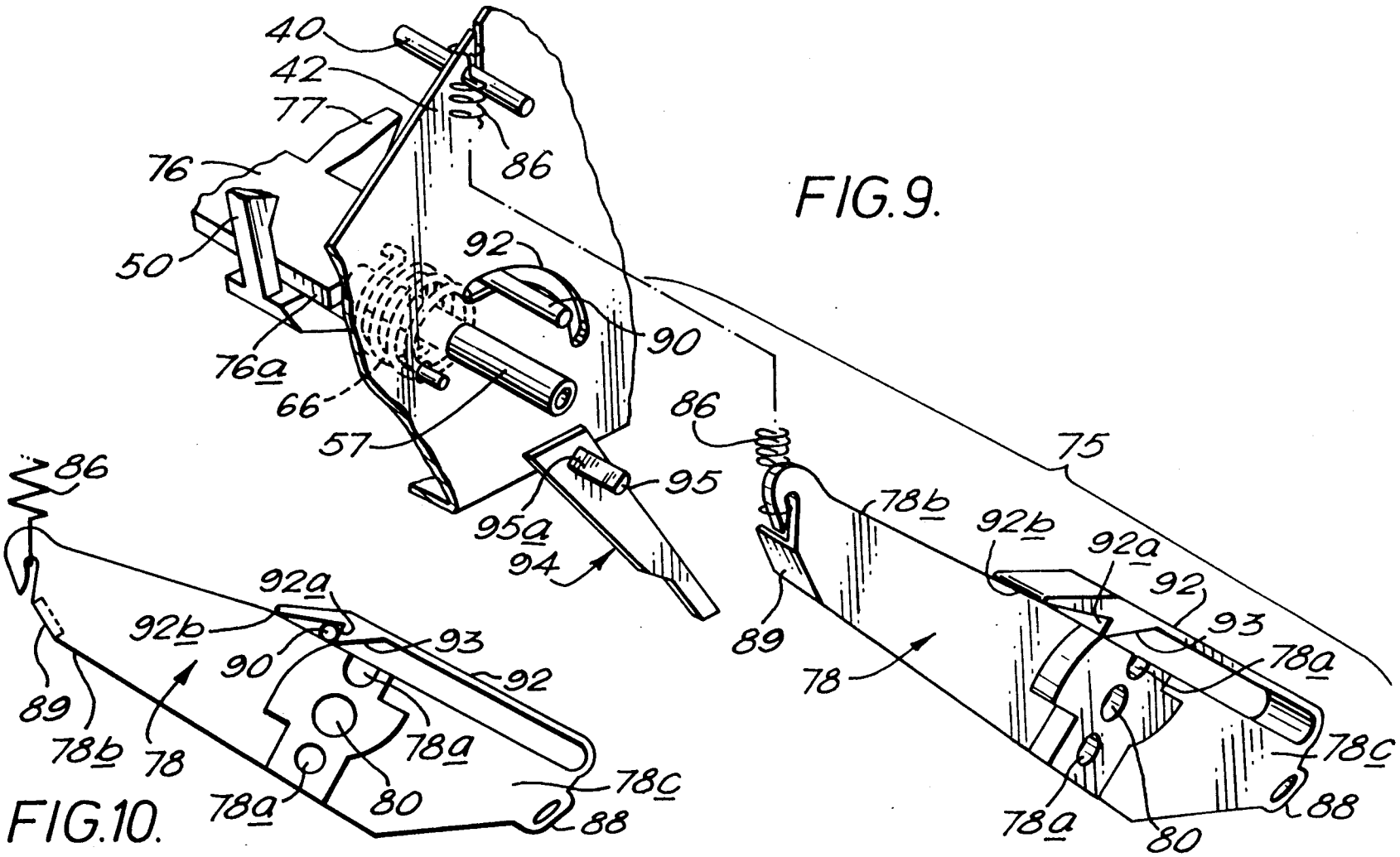
FIG. 9 is an exploded view of the parts of the handle actuating mechanism.
FIG. 10 is an elevational detail of part of the handle actuating mechanism.

As the member 76 is pivoted clockwise in the sense viewed in FIG. 6, to the position shown in FIG. 8, in a manner to be described, then the contact surface 76*a* engages the member 56 and causes it to pivot likewise. This withdraws the levers 50, from engagement with the teeth 44 and since the lug 60 ceases to contact the arm 67*a*, the crank 67 is pivoted to the position shown in FIGS. 6 and 8, if not already in that position, and shuts the door 24. The pivoting of the member 56 also causes it to engage the cam surfaces 48*b* on the levers 48 and additionally withdraws them so that their respective ends no longer engage the teeth 44. The wheels 18, 20 and 22 are therefore free to rotate as regards the levers 48 and 50. However, pivoting of the member 76 raises the fingers 77 which engage in the teeth 44 of the respective wheels 18, 20 and 22.

Attached between the member 76 and the frame 42 is a strong coil spring 78 (FIG. 4) and the member 76 is pivoted to the position shown in FIG. 8 against the action of that spring. As will be described the clutch 75 suddenly releases the member 76, which can therefore snap back rapidly to its rest position shown in FIGS. 6 and 7. The resulting engagement of the fingers 77 with the teeth 44 of their respective wheels causes the wheels to spin rapidly in a clockwise sense as viewed in FIG. 8. Because of the damper arrangement 62, the levers 48 do not immediately engage and stop this spinning of the wheels but one by one the levers 48 stop their respective wheels at a random point and then the levers 50 engage the wheels to sense whether the wheels have stopped at a winning combination.

The clutch 74 includes crank 78. This is rigidly attached by screws (not shown) to the handle 26, the handle having a pair of circular projections (not shown) which engage in corresponding holes 78*a* in the crank 78. It has a central hole 80 through which the axle 57 passes and so is freely rotatably mounted on that axle 57. The crank has a first arm 78*b* to which is attached a spring 86 fixed to the casing 42 and a second arm 78*c* whose outer end has a stop surface 88 which engages a ledge 42*a* forming part of the frame 42 to prevent the handle from returning beyond the upright position. The arm 78*c* also has a stop surface 89 engageable with the ledge 42*a* when the handle is at its other extreme forward position.

The member 56 has a pin 90 projecting from its end through a slot 92 in the frame 42. The pin 90 also forms the point for attaching the spring 78 (FIG. 4) to the member 56.

The arm 78*c* of the crank 78 has a resilient arm 92 extending forwardly from its rear end. This arm has near its free end, a recess 92*a* between the arm and the main body of the crank in which the end of the pin 90 is normally received. At the end 92*b* of the arm 92 is a contact whose function will be described. Also behind the recess 92*a* is an inclined cam surface 93 whose function will also be described below.

The other point of the clutch 75 comprises a member 94 fixed to the side of the frame 42 and having an abutment 95. This is in the form of a pin projecting towards the crank 78 and has a flattened top surface 95*a*. As an alternative the abutment 95 could be integrally formed as part of the frame 42, eg where the frame is metal it could be a lug bent or stamped out of line or where the frame is moulded from plastics material it could be an integrally formed projection.

In the rest position, the spring 86 urges the crank 78 so that the handle 26 adopts an upright position. Also in that position the rod 90 will be engaged in the recess 92*a* when the handle is pivoted forwardly to operate the mechanism, the crank 78 pivots and the member 76 is also pivoted because of the engagement of the pin 90 in the recess 92*a*. Additionally as noted above this moves the levers 48 and 50 clear of the wheels 18, 20 and 22 and engages the fingers 77 with the teeth 44.

Eventually the pivoting of the handle and crank 78 reaches a point where the end 92*b* engages the abutment 95, and in particular the surface 95*a*. It slides across that surface and the engagement moves the arm 92 away from the rest of the crank 78. Continued pull on the handle 24 causes the arm 92 to move so that the pin can suddenly disengage from the recess 92*a*. The member 76 is therefore suddenly free to move to its initial position under the effect of the spring 78 which as explained above sets the wheels 18, 20 and 22 spinning, the pin 90 moving between the arm 92 and the main body of the crank 78.

The handle 26 can now be released. The spring 86 will therefore restore the handle to its upright position. In so doing the cam surface 93 will eventually engage the pin 90 and this will cam the arm 92 outwardly so that the pin can return to the recess 92*a* and so the crank 78 again become linked by that engagement to the member 76.

An advantage of the invention is that the arm 92 will have some inherent resiliency. Therefore should any part of the mechanism jam, whilst a person is operating the handle, this arm can be designed to give and bend before any other part breaks, its bending causing the pin 92 to disengage from the recess 92*a* and so release the clutch. Thus, the clutch will release rather than some part of the mechanism break.

It is believed that the operation and advantages of the toy 10 will be apparent from the above description. In particular the operating mechanism is designed to reduce the chances of damage upon misuse such as will occur with a toy.

A latitude of modification, change and substitution is intended in the foregoing disclosure and in some instances some features of the invention will be employed without a corresponding use of other features. Accordingly it is appropriate that the appended claims be construed broadly and in a manner consistent with the spirit and scope of the invention herein.

I claim:

1. A toy money box comprising:

an outer casing, a coin inlet formed in said casing, a money store within said casing into which coins pass when inserted through said coin inlet, a number of rotatable chance wheels mounted in said casing and arranged to be spun and stopped at random orientations, indicia carried by said wheels, only certain of said indicia being winning indicia when a respective wheel stops with one of said certain indicia in a winning orientation, whereby when said wheels stop in a winning orientation the resulting array of indicia corresponds to a jackpot position, means within said casing for determining a jackpot position and releasing stored coins from said money store upon determination of a jackpot position, a handle pivotally mounted to said casing at an outer surface thereof about an axis of pivoting for setting said wheels spinning, spring loaded fingers mounted in said casing for engaging respective wheels, said fingers being movable to a loaded position in contact with said wheels whereby their release spins a respective wheel as said fingers moves to a retracted rest position, a clutch mechanism driven by said handle, said clutch mechanism moving said fingers towards said loaded position as said handle is pivoted, continued pivoting of said handle releasing said clutch and said fingers whereby said fingers can then move to said retracted rest position, and said clutch mechanism including a crank pivotally mounted to said casing about said axis of pivoting and including a first arm having an outer end spaced from said axis, a substantially straight resilient finger integrally formed with said first arm and projecting from said outer end alongside said arm, recess means defined between said resilient finger and said first arm, engagement means projecting from said spring loaded fingers and normally engaged in said recess means, so that pivoting movement of said handle and crank will produce a corresponding pivotal movement of said spring loaded fingers to said located position, a stationary abutment on said casing, a forward end of said resilient finger engaging said abutment as said fingers approach said loaded positions, continued pivoting of said handle and said crank causing said abutment to displace said resilient finger to release said engagement means from said recess means.

2. A toy money box according to claim 1 and further comprising:

a base to said money store hingedly mounted about an axis of pivoting to said casing at the outer surface thereof so as to be movable by hinging downwardly under its own weight between a normally closed position to retain coins in said store and an open jackpot position to release coins from said store, when said wheels stop in a winning orientation the resulting array of indicia corresponds to said jackpot position and movement of said base to said open jackpot position, an arm integrally formed with said base to said money store, said arm projecting away from said axis of pivoting of base, a crank pivotally mounted to said casing and resiliently urged about its axis of pivoting in an first direction, an arcuate cam surface on said crank engaging said arm and locking said arm and base in said normally closed position, and sensing means pivotally mounted in said casing for engaging said wheels to detect winning orientations of winning indicia, said sensor means being resiliently urged to a second position but stopped at a first position when said wheels are not all stopped in a winning orientation, said sensor means being movable to said second position when a jackpot position is detected, said sensor means engaging said crank when they move to said, second position to displace said crank in a direction opposite to said first direction, to release said arm from said arcuate cam surface to allow said base to hinge open.

3. A toy money box as claimed in claim 2 in which said crank further includes a contact surface which engages said arm on said base as said crank is resiliently returned in said first direction, the contact causing said base to pivot to its closed position and thereafter said arm being engaged by said arcuate surface to lock said base in said closed position upon continued movement of said crank in said first direction.

4. A toy money box according to claim 2 further comprising a circular set of gear teeth integrally formed in one side face of each chance wheel, said teeth comprising alternative crests and troughs with selected troughs absent, absence of a trough corresponding to a winning indicia, said sensor means detecting a winning indicia by being capable of moving to said second position through an absent trough and being stopped at said first position by a trough.

5. A toy money box according to claim 4 in which said sensor means includes a member pivotally mounted in said casing and having integrally formed sensing fingers, each of said fingers having an outer narrow end capable of engaging in a trough to define said first position and passing through a missing trough to allow said member to move to said second position when all of said fingers pass through a missing trough simultaneously.

6. A toy money box according to claim 5 in which said sensor means further includes sensing levers one associated with each wheel.

7. A toy money box according to claim 4 further comprising a stopping lever associated with each wheel resiliently mounted in said casing, said levers having an outer end capable of engaging said teeth of a respective wheel to stop rotation at a random orientation, means being provided to withdraw said levers prior to spinning said wheels and to release said levers one by one to engage said teeth after said wheels have been set spinning.

8. A toy money box according to claim 7 in which said stopping levers are integrally formed on a single member, said member having means for the snap-fitting attachment of said member to said casing.

9. A toy money box according to claim 7 further comprising damping means mounted in said casing to delay movement of said stopping levers to engage said teeth.

10. A toy money box according to claim 2 further comprising damping means mounted in said casing to delay movement of said stopping levers to engage said teeth, movement of said fingers to said loaded position contacting said stopping levers to withdraw them, and retracting said sensing fingers form contact with the respective teeth, and release of said fingers releasing said stopping levers and sensing fingers for said damping means to delay their return.

11. A toy money box comprising:

an outer casing, a coin inlet formed in said casing, a money store within said casing into which coins pass when inserted through said coin inlet, a number of rotatable chance wheels mounted in said casing and arranged to be spun and stopped at random orientations, indicia carried by said wheels, only certain of said indicia being winning indicia when a respective wheel stops with one of said certain indicia in a winning orientation, whereby when said wheels stop in a winning orientation the resulting array of indicia corresponds to a jackpot position, means within said casing for determining a jackpot position and releasing stored coins from said money store upon determination of a jackpot position, a handle pivotally mounted to said casing at an outer surface thereof about an axis of pivoting for setting said wheels spinning, spring loaded fingers mounted in said casing for engaging respective wheels, said fingers being movable to a loaded position in contact with said wheels whereby their release spins a respective wheel as said fingers moves to a retracted rest position, a clutch mechanism driven by said handle, said clutch mechanism moving said fingers towards said loaded position as said handle is pivoted, continued pivoting of said handle releasing said clutch and said fingers whereby said fingers can then move to said retracted rest position, and said clutch mechanism including a crank pivotally mounted to said casing about said axis of pivoting and including a first arm having an outer end spaced from said axis, a substantially straight resilient finger integrally formed with said first arm and projecting from said outer end alongside said arm, recess means defined between said resilient finger and said first arm, engagement means projecting from said spring loaded fingers and normally engaged in said recess means, so that pivoting movement of said handle and crank will produce a corresponding pivotal movement of said spring loaded fingers to said located position, a stationary abutment on said casing, a forward end of said resilient finger engaging said abutment as said fingers approach said loaded positions, continued pivoting of said handle and said crank causing said abutment to displace said resilient finger to release said engagement means from said recess means, said resilient finger further comprising a cam surface between said finger and said first arm and leading to said recess means, whereby when said handle and crank are returned to their initial position after release of said engagement means from said recess means, said engagement means engage said cam surface and resiliently displace said resilient finger to allow said engagement means to re-enter said recess means.

12. A toy money box comprising:

an outer casing, a coin inlet formed in said casing, a money store within said casing into which coins pass when inserted through said coin inlet, a number of rotatable chance wheels mounted in said casing and arranged to be spun and stopped at random orientations, indicia carried by said wheels, only certain of said indicia being winning indicia when a respective wheel stops with one of said certain indicia in a winning orientation, whereby when said wheels stop in a winning orientation the resulting array of indicia corresponds to a jackpot position, means within said casing for determining a jackpot position and releasing stored coins from said money store upon determination of a jackpot position, a handle pivotally mounted to said casing at an outer surface thereof about an axis of pivoting for setting said wheels spinning, spring loaded fingers mounted in said casing for engaging respective wheels, said fingers being movable to a loaded position in contact with said wheels whereby their release spins a respective wheel as said fingers moves to a retracted rest position, a clutch mechanism driven by said handle, said clutch mechanism moving said fingers towards said loaded position as said handle is pivoted, continued pivoting of said handle releasing said clutch and said fingers whereby said fingers can then move to said retracted rest position, and said clutch mechanism including a crank pivotally mounted to said casing about said axis of pivoting and including a first arm having an outer end spaced from said axis, a substantially straight resilient finger integrally formed with said first arm and projecting from said outer end alongside said arm, recess means defined between said resilient finger and said fist arm, said first arm having a first contact surface at its outer end and said casing having contact means contacted by said first contact surface when the handle is in its non-operative position, said crank further comprising a second arm projecting away from said first arm and having an outer end provided with a second contact surface, said second contact surface being contacted by said contact means on said casing once said handle has been pivoted to a position when said engagement means have released from said recess means, to thereby limit further pivoting movement of said handle, engagement means projecting from said spring loaded fingers and normally engaged in said recess means, so that pivoting movement of said handle and crank will produce a corresponding pivotal movement of said spring loaded fingers to said located position, a stationary abutment on said casing, a forward end of said resilient finger engaging said butment as said fingers approach said loaded positions, continued pivoting of said handle and said crank causing said abutment to displace said resilient finger to release said engagement means from said recess means.

13. A toy money box comprising:

an outer casing, a first coin inlet formed in said casing a money store within said casing into which coins pass when inserted into said coin inlet, a base to said money store hingedly mounted to said casing at the outer surface thereof so as to be movable by hinging downwardly under its own weight between a normally closed position to retain coins in said store and an open jackpot position to release coins from said store, a number of rotatable chance wheels mounted in said casing and arranged to be spun and stopped at random orientations, indicia carried by said wheels, only certain of said indicia being winning indicia when a respective wheel stops with one of said certain indicia in a winning orientation, whereby when said wheels stop in a winning orientation the resulting array of indicia corresponds to movement of said base to said jackpot position, a circular set of gear teeth integrally formed in one side face of each chance wheel, said teeth comprising alternative crests and troughs with selected troughs absent, absence of a trough corresponding to a winning indicia, sensor means for detecting a winning indicia by being stopped at a first position by a trough and being capable of moving through an absent trough to a second position, said sensor means including a member pivotally mounted in said casing and having integrally formed sensing fingers, each of said fingers having an outer narrow end capable of engaging in a trough to define said first position and passing through a missing trough to allow said member to move to said second positions when all of said fingers pass through a missing trough simultaneously, means to withdraw said levers prior to spinning said wheels and to release said levers one by one to engage said teeth after said wheels have been set spinning, and said stopping levers being integrally formed on a single member, said member having means for the snap-fitting attachment of said member to said casing.

14. A toy money box according to claim 13 further comprising damping means mounted in said casing to delay movement of said stoping levers to engage said teeth, movement of said fingers to said loaded position contacting said stopping levers to withdraw them, and retracting said sensing fingers form contact with the respective teeth, and release of said fingers releasing said stopping levers and sensing fingers for said damping means to delay their return.

* * * * *